US008559276B2

(12) United States Patent
Blondeau

(10) Patent No.: US 8,559,276 B2
(45) Date of Patent: Oct. 15, 2013

(54) SYSTEM FOR TIMING A SPORTS COMPETITION WITH TWO TIMING DEVICES

(75) Inventor: Fabien Blondeau, Chezard St-Martin (CH)

(73) Assignee: Swiss Timing, Corgemont (CH)

( * ) Notice: Subject to any disclaimer, the term of this patent is extended or adjusted under 35 U.S.C. 154(b) by 198 days.

(21) Appl. No.: 13/085,852

(22) Filed: Apr. 13, 2011

(65) Prior Publication Data

US 2011/0261657 A1 Oct. 27, 2011

(30) Foreign Application Priority Data

Apr. 27, 2010 (EP) ..... 10161103

(51) Int. Cl.
*G04C 11/00* (2006.01)

(52) U.S. Cl.
USPC ..... 368/113; 368/156; 331/46; 327/147

(58) Field of Classification Search
USPC ..... 368/46, 47, 110–113, 119, 156, 3, 9, 10
See application file for complete search history.

(56) References Cited

U.S. PATENT DOCUMENTS

| | | | | | |
|---|---|---|---|---|---|
| 4,178,750 | A * | 12/1979 | Murakami et al. | ..... | 368/56 |
| 4,383,166 | A * | 5/1983 | Chu et al. | ..... | 377/20 |
| 4,551,665 | A * | 11/1985 | Antognini et al. | ..... | 318/696 |
| 4,899,117 | A * | 2/1990 | Vig | ..... | 331/3 |
| 5,206,857 | A * | 4/1993 | Farleigh | ..... | 370/452 |
| 5,912,728 | A * | 6/1999 | Besesty et al. | ..... | 356/5.01 |
| 6,055,362 | A * | 4/2000 | Kesner et al. | ..... | 714/1 |
| 6,226,231 | B1 * | 5/2001 | Kattan | ..... | 368/113 |
| 6,636,459 | B1 * | 10/2003 | Nagata | ..... | 368/204 |
| 6,950,375 | B2 * | 9/2005 | Duffner et al. | ..... | 368/113 |
| 2003/0076181 | A1 * | 4/2003 | Tabatabaei et al. | ..... | 331/57 |
| 2003/0117899 | A1 * | 6/2003 | Eidson | ..... | 368/46 |
| 2007/0286028 | A1 | 12/2007 | Meltzer et al. | | |
| 2009/0129208 | A1 * | 5/2009 | Weiss | ..... | 368/56 |
| 2010/0315138 | A1 * | 12/2010 | Namba et al. | ..... | 327/157 |

FOREIGN PATENT DOCUMENTS

| | | | |
|---|---|---|---|
| EP | 1 139 299 | A1 | 10/2001 |
| EP | 2 063 330 | A2 | 5/2009 |
| JP | 2003-139880 | A | 5/2003 |
| JP | 2005-283337 | A | 10/2005 |
| JP | 2006-30002 | A | 2/2006 |
| JP | 2009194428 | A * | 8/2009 |

OTHER PUBLICATIONS

European Search Report for EP 10 16 1103 dated Sep. 21, 2010.

* cited by examiner

*Primary Examiner* — Amy Cohen Johnson
*Assistant Examiner* — Matthew Powell
(74) *Attorney, Agent, or Firm* — Sughrue Mion, PLLC

(57) ABSTRACT

The system for timing a sports competition includes a main timing device having a first time base, and a secondary timing device having a second time base (5). The two timing devices are capable of operating in parallel when the timing system is enabled. The two timing devices are arranged such that the second time base (5) is synchronized by using a reference timer signal (CLKref) generated by the first time base. The second time base (5) includes a phase lock loop (10, 11, 12, 13, 14, 17) for adapting the frequency of the second timer signal (CLK_T2) according to the frequency of the reference timer signal (CLKref).

6 Claims, 1 Drawing Sheet

SYSTEM FOR TIMING A SPORTS COMPETITION WITH TWO TIMING DEVICES

This application claims priority from European Patent Application No. 10161103.6 filed Apr. 27, 2010, the entire disclosure of which is incorporated herein by reference.

FIELD OF THE INVENTION

The invention concerns a system for timing a sports competition, which includes a main timing device and a secondary timing device. The two timing devices are capable of operating in parallel as soon as a start pulse is given for a sports race. Both devices are therefore able to supply race times in case there is any problem with one of the timing devices.

BACKGROUND OF THE INVENTION

The use of at least two timing devices, which each has its own initially calibrated time base, has become necessary for timing important sports competitions, such as for example, ski races. The two timing devices operate independently of each other, but receive the same race start pulse supplied by the same start gate. The timing devices also receive the same stop pulse for the timing of a race as soon as the competitor crosses the finish line. The race times of the two timing devices can be stored in a known way for each competitor. Moreover, the time of one or several races, particularly of the main device, can be displayed on a display screen, which may be visible to spectators.

For both timing devices, only one calibration is performed for each time base, initially, for example, in the factory before the timing system is used for the proper conduct of the sports competition. The operation of the two timing devices, which may be arranged in the same timing system apparatus, ensures continuity of timing in the event that one of the devices fails. However, throughout the sports competition, the time bases of the two devices may vary slightly. This may result in two time measurements rounded off to a hundredth or thousandth of a second, which are different. This is therefore a drawback of this type of timing system, which has to guarantee a high level of timing precision.

EP Patent No. 1 139 299 A1 may be cited, which discloses a radio transmission timing system. The system includes several peripheral units, each provided with a time base and a radio signal transmission means. The peripheral units are arranged at different places on the course or track of a sports competition in order to take a start time, intermediate times and a finish time for each competitor. Time shiftings between said units are unavoidable given that they are arranged remote each other. The time bases of each unit have to be synchronised relative to each other by radio or GPS signals. This requires an imposing infrastructure in order to ensure proper synchronisation of each unit for measuring the different times of the sports competition, which constitutes a drawback.

SUMMARY OF THE INVENTION

It is thus an object of the invention to overcome the drawbacks of the prior art by providing a timing system with at least two timing devices, which maintain identical timing for the two time bases throughout the sports competition with a high level of precision.

The invention therefore concerns the aforecited timing system for a sports competition, which includes a main timing device having a first time base and a secondary timing device having a second time base, wherein both timing devices are capable of operating in parallel when the timing system is enabled, both timing devices being arranged such that the two time bases are synchronised with each other in normal operating mode, wherein the second time base is synchronised using the first time base.

Specific embodiments of the timing system are defined in the dependent claims 2 to 6.

One advantage of the timing system lies in the fact that the two time bases are synchronised with each other. Preferably, the second time base is synchronised using the first time base. This means that the frequency of the timer or clock signals of the two time bases can be precisely matched throughout the operating period provided that both timing devices are operating properly. The coherence of the time bases is thus automatically controlled.

BRIEF DESCRIPTION OF THE DRAWINGS

The objects, advantages and features of the timing system for a sports competition will appear more clearly in the following description on the basis of at least one non-limiting embodiment illustrated by the drawings, in which.

DETAILED DESCRIPTION OF THE INVENTION

In the following description, all those elements of the timing system for a sports competition that are well known to those skilled in the art in this technical field will be described only in a simplified manner. Reference is mainly made to two timing devices of the timing system, although several other timing devices may also be connected in parallel.

Figure 1:
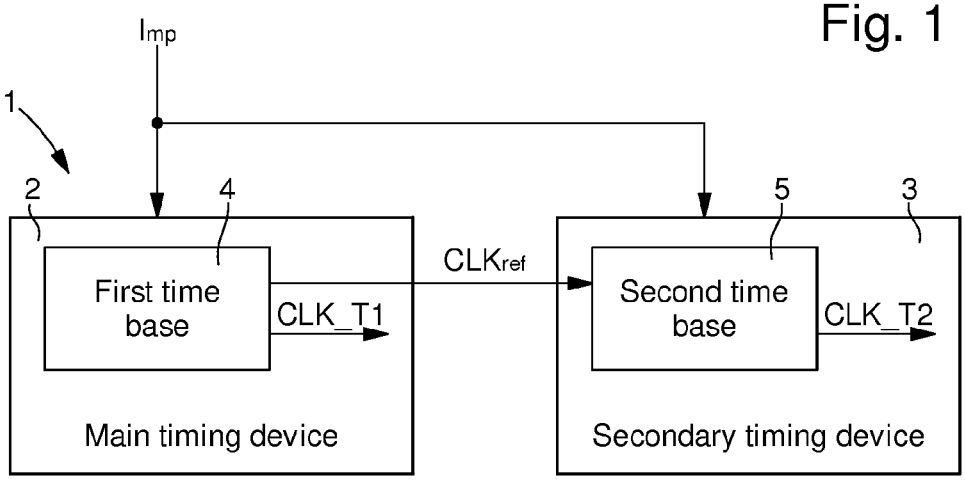
FIG. 1 shows schematically two timing devices of the timing system according to the invention.

FIG. 1 shows schematically a timing system 1 intended to be used for a sports competition, such as a ski race. In addition to other well known components, timing system 1 includes a main timing device 2 and a secondary timing device 3. Main timing device 2 includes a first time base 4, while secondary timing device 3 includes a second time base 5. Each time base 4 and 5 is provided with a quartz oscillator unit, calibrated at a frequency, for example, on the order of 10 MHz. According to the invention, the second time base 5 is synchronised with the first time base 4 by means of a reference timer signal CLKref supplied by first time base 4. This reference timer signal CLKref may be defined with a frequency on the order of 10 MHz and is normally equivalent to the first timer or clock signal CLK_T1 supplied by main timing device 2. Secondary timing device 3 supplies a second timer or clock signal CLK_T2, which must be identical to the first timer or clock signal.

Purely by way of example, the frequency shift or deviation between the two time bases 4 and 5, once calibrated, may be less than 0.2 ppm, and preferably less than 0.1 ppm. The two timing devices 2 and 3 with the two time bases 4 and 5 are powered on before the start of the sports competition so as to ensure good stability of the various electronic components.

It should be noted that the two timing devices 2 and 3 could be mounted in the same electronic apparatus (not shown) of timing system 1, rather than in two separate apparatus. This apparatus generally has, in a known manner, various outlets for connection to other electronic apparatus or other timing devices, and a set of buttons for activating certain particular functions of the apparatus. One of timing devices 2 and 3 can also be selected by pressing at least one corresponding button of the apparatus particularly in the event that one of the devices fails. A choice may be made as to which timing device has to supply the race time to a display screen for example.

The apparatus with the two operating timing devices 2 and 3 may have a cable or wireless connection to a start gate. As soon as the start gate is opened, a race start pulse Imp is transmitted to the two timing devices to start the race time measurement. A stop pulse (not shown) for the race time measurement is also supplied to the two timing devices 2 and 3 when the competitor crosses the finish line. Several race times can be stored in each timing device or in memory units of the apparatus connected to the two devices.

Figure 2:
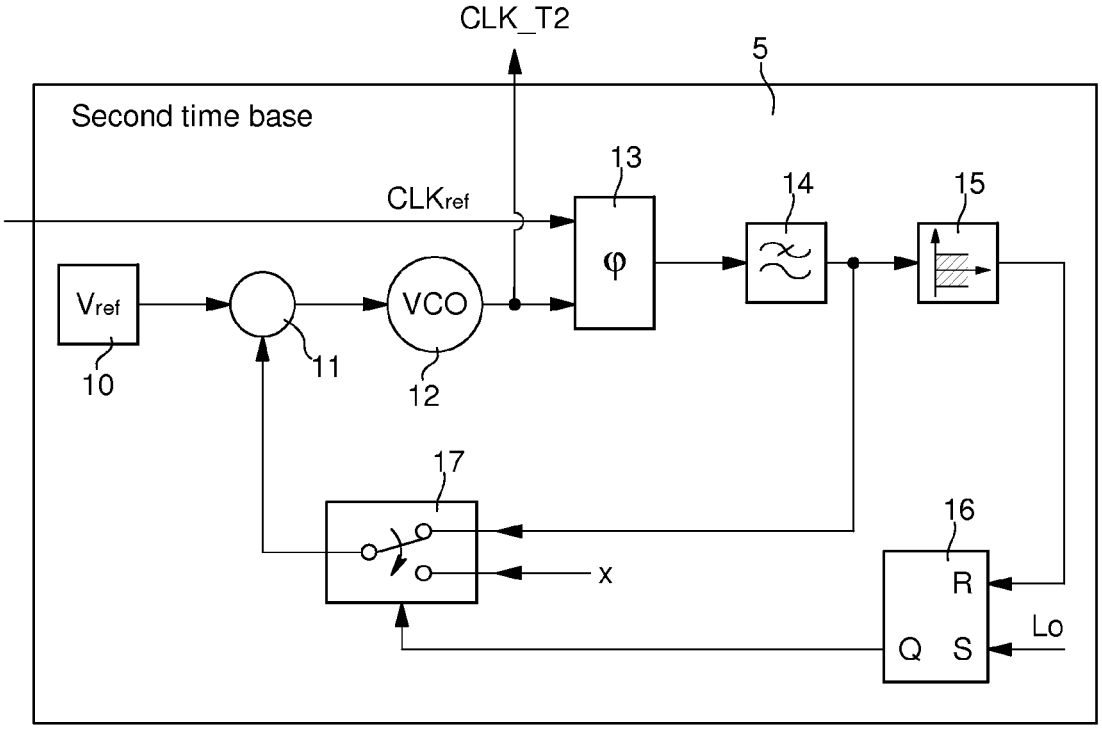
FIG. 2 shows a simplified view of the various elements of the second time base of the secondary timing device of the timing system according to the invention.

FIG. 2 shows a simplified view of the various elements of the second time base 5 of the timing device. The second time base 5 is synchronised by means of the reference timer signal CLKref supplied by the first time base so that the second timer signal CLK_T2 supplied by the second time base has an equivalent frequency to the first timer signal of the main timing device.

The second time base 5 thus includes a phase lock loop, usually designated PLL, for synchronising the second time base 5 with the first time base. Normally, each time base mainly includes a reference voltage generator Vref 10, which supplies a reference voltage Vref to the input of a voltage controlled oscillator VCO 12. On the basis of this reference voltage Vref, voltage controlled oscillator 12 can thus generate a timer signal at a frequency close to 10 MHz. The reference voltage is very well controlled to guarantee good frequency precision for each timer signal.

The phase lock loop of the second time base 5 includes a phase and frequency detector 13 for comparing the reference timer signal CLKref to the second timer signal CLK_T2 generated by voltage controlled oscillator 12. The result of this comparison in the detector is provided to a filtering element which is preferably a conventional low pass filter 14. However, it is also conceivable for the filtering element to be a simple integrator. The initially observed deviation between reference timer signal CLKref and the second timer signal CLK_T2 is corrected by an adaptive voltage supplied at the low pass filter output 14. If the two timer signals have an identical frequency at the start, normally this adaptive voltage is theoretically equal to 0 V.

The adaptive voltage at the output of low pass filter 14 must be supplied to voltage controlled oscillator 12 to adapt the frequency of the second timer signal CLK_T2 as hoped. In order to do this, the adaptive voltage is added by a conventional adder 11 to reference voltage Vref. This adaptive voltage is supplied to adder 11 via a switch 17, which, in this control phase, is switched to connect low pass filter 14 to adder 11. As long as the adaptive voltage is below a predefined threshold, the lock loop is in a closed state with switch 17 switched to connect the output of low pass filter 14 to adder 11.

The second time base 5 also includes a voltage comparator 15 connected to the output of low pass filter 14 so as to compare the adaptive voltage to an admissible voltage threshold. If this adaptive voltage is above the allowed predefined voltage threshold, a control signal is supplied to an RS flip-flop 16, so that the flip-flop opens switch 17. The control signal is preferably applied to the reset input R of RS flip-flop 16. As the control signal changes from the "0" state to the "1" state, when the adaptive voltage is above the allowed threshold, the control signal sets the flip-flop output Q, which is used for controlling switch 17, to 0. Setting output Q to 0 results in switch 17 opening. Switch 17 is made to close by the change from the "0" state to the "1" state, when the input S of RS flip-flop 16 is set to 1. A command Lo is initially applied to input S of flip-flop 16 when the timing devices are powered on, which has the effect of closing the phase lock loop as desired.

As indicated above, when switch 17 is opened by the signal from output Q in the "0" state of flip-flop 16, this causes the phase lock loop to open. In this situation, a voltage x is added to reference voltage Vref to adapt the frequency of the second timer signal generated by voltage controlled oscillator 12. Generally, this voltage x has a value of 0 V, which corresponds to the initial calibrating situation of voltage controlled oscillator 12. However, it is possible to envisage voltage x being defined at an allowable adaptive voltage value, when the phase lock loop is in a closed position. The allowable adaptive voltage value corresponds to the allowable frequency deviation between the frequency of reference timer signal CLKref and the initial frequency of the second timer signal. This frequency deviation may be defined as less than 0.2 ppm and preferably less than 0.1 ppm.

During the sports competition, it may happen that the first time base of the main timing device has a problem which could result in an incorrect race time measurement. In such case, the frequency of reference timer signal CLKref moves away from an initial reference frequency, which corresponds to the initial frequency of second timer signal CLK_T2 generated by voltage controlled oscillator 12. The adaptive voltage at the output of low pass filter 14 thus passes above the voltage threshold of comparator 15. This initial frequency of the second timer signal is thus based purely on the reference voltage Vref applied to the input of voltage controlled oscillator 12. In the event of a problem with the main timing device, the secondary timing device separates itself from the main device, for all subsequent race time measurements.

Because of the second time base 5, it is therefore possible to control the proper operation of the main timing device. Good synchronisation with second time base 5 is also carried out as expected by means of the first time base. However, a problem may also arise in the secondary timing device, making it necessary to leave the main timing device to manage the timing.

From the description that has just been given, several variants of the timing system for a sports competition can be devised by those skilled in the art without departing from the scope of the invention defined by the claims.

What is claimed is:

1. A system for timing a sports competition, which includes a main timing device having a first time base and a secondary timing device having a second time base, wherein both timing devices are capable of operating in parallel when the timing system is enabled in order to receive a race start pulse to start the race time measurement and a stop pulse for the race time measurement, both timing devices being arranged such that the two time bases are synchronised with each other in normal operating mode, wherein the second time base is synchronised using the first time base, and wherein the second time base includes a phase lock loop wherein a reference timer signal supplied by the first time base is compared to a second timer signal generated by a quartz oscillator so as to adapt the frequency of the second timer signal.

2. The timing system according to claim 1, wherein the quartz oscillator is a voltage controlled oscillator, which is initially controlled by a reference voltage supplied by a reference voltage generator.

3. The timing system according to claim 1, wherein the phase lock loop includes a phase and frequency detector for comparing the frequency of the reference timer signal to the frequency of the second timer signal, a low pass filter connected to the output of the phase and frequency detector to supply at an output thereof an adaptive voltage, an adder for receiving the adaptive voltage via a switch in a closed position, which is added to the reference voltage, the adder supplying a control voltage to a voltage controlled oscillator, which generates the second timer signal at an adapted frequency.

4. The timing system according to claim 3, wherein the second time base includes a voltage comparator connected to the output of the low pass filter to compare the adaptive voltage to an allowable voltage threshold, an RS flip-flop controlled by a control signal produced by the voltage comparator, an output of the flip-flop being provided for opening the switch if the adaptive voltage is above the voltage threshold of the comparator.

5. The timing system according to claim 3, wherein the switch includes two inputs and one output, wherein a first input receives the adaptive voltage from the low pass filter, whereas the second input receives a defined continuous voltage, in a closed position of the switch, the adaptive voltage being added to the reference voltage in a closed phase lock loop, whereas in an open position of the switch, the defined continuous voltage is added to the reference voltage with the phase lock loop in the open position.

6. The timing system according to claim 4, wherein a reset input of the RS flip-flop is controlled by the control signal produced by the comparator, and wherein a set-to-1 input of the RS flip-flop is controlled by another control signal for closing the phase lock loop.

* * * * *